US005590594A

United States Patent [19]

Pederson

[11] Patent Number: 5,590,594

[45] Date of Patent: Jan. 7, 1997

[54] TIRE BALING MACHINE

[76] Inventor: Les H. Pederson, 2602 W. Sixth St., Sioux City, Iowa 51103

[21] Appl. No.: 521,879

[22] Filed: Aug. 31, 1995

[51] Int. Cl.[6] ..... B30B 9/30

[52] U.S. Cl. ..... 100/218; 100/3; 100/100; 100/220; 100/255

[58] Field of Search ..... 100/3, 34, 100, 100/218, 220, 255, 269.06

[56] References Cited

U.S. PATENT DOCUMENTS

| | | | |
|---|---|---|---|
| 277,101 | 5/1883 | Babcock | 100/255 |
| 381,263 | 4/1888 | Liddell | 100/255 |
| 1,030,648 | 6/1912 | Cramer | 100/255 |
| 1,162,833 | 12/1915 | Wareham | 100/255 |
| 1,646,355 | 10/1927 | Hill | 100/255 |
| 1,761,447 | 6/1930 | MacLean et al. | 100/255 |
| 1,845,572 | 2/1932 | Wallace | 100/255 |
| 2,337,705 | 12/1943 | Barrows et al. | 100/254 |
| 2,421,465 | 6/1947 | Schley | 100/255 |
| 2,476,574 | 7/1949 | Aluotto | 100/255 |
| 2,738,726 | 3/1956 | Moser | 100/220 |
| 2,848,940 | 8/1958 | Jonsson | 100/255 |
| 3,851,577 | 12/1974 | Newcom et al. | 100/255 |
| 4,002,115 | 1/1977 | Nanoia | 100/220 |
| 4,080,889 | 3/1978 | Shiloni | 100/255 |
| 4,136,610 | 1/1979 | Tyler, Jr. | 100/100 |
| 4,182,236 | 1/1980 | Greer | 100/220 |
| 4,294,169 | 10/1981 | Baird | 100/255 |
| 4,777,873 | 10/1988 | Zimmer | 100/218 |
| 5,341,731 | 8/1994 | Grizzard, Jr. et al. | 100/100 |

FOREIGN PATENT DOCUMENTS

| | | | |
|---|---|---|---|
| 3860/31 | 8/1932 | Australia | 100/220 |
| 444122 | 10/1912 | France | 100/255 |
| 2145704 | 3/1972 | Germany | 100/3 |
| 515835 | 12/1939 | United Kingdom | 100/255 |
| 1594668 | 8/1981 | United Kingdom | 100/255 |

OTHER PUBLICATIONS

"New Products: Baling press can be filled on either side", Refuse Removal Journal, vol. 8, No. 7, p. 37 Jul. 965.

*Primary Examiner*—Stephen F. Gerrity

[57] ABSTRACT

A portable tire baling machine mounted on a trailer for transportation. The baler has unique fingers for holding partially baled tires for additional loading to make possible larger bales from a relatively smaller machine. Special provisions are made for holding the bales together and for emptying the bales from the machine. The method of loading the bales provides for added safety and a better, tighter bale. Safety features for the closure of the baling compartment are also provided.

11 Claims, 4 Drawing Sheets

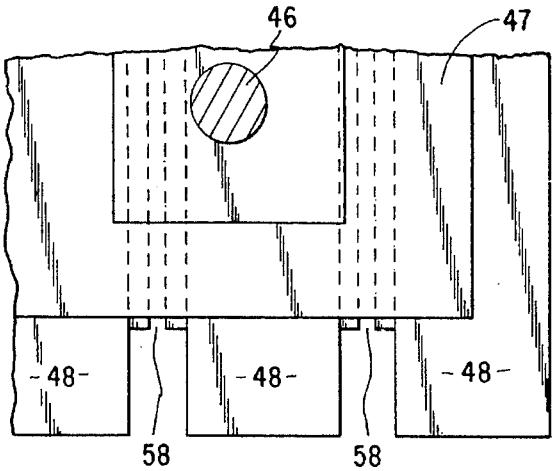
FIG. 17
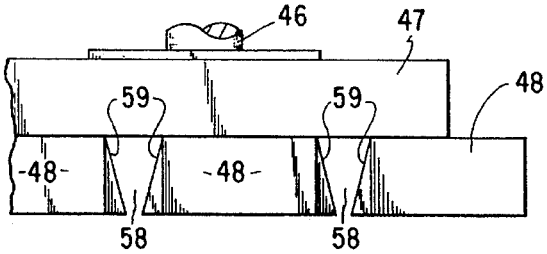
FIG. 18
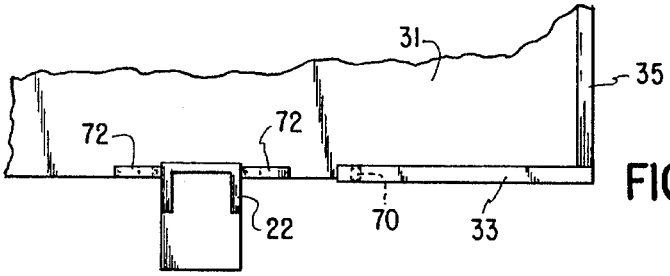
FIG. 14
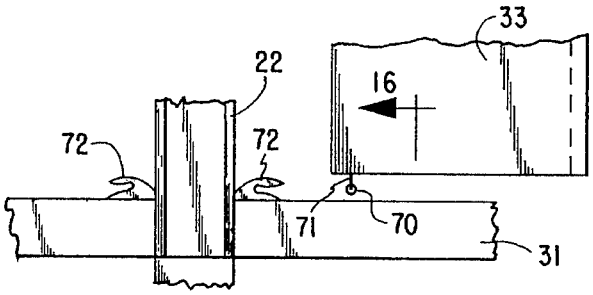
FIG. 15
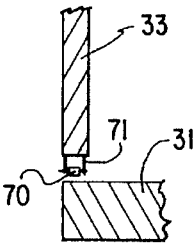
FIG. 16
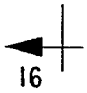

TIRE BALING MACHINE

BACKGROUND AND SUMMARY OF THE INVENTION

This invention pertains to devices for compact disposition of discarded tire casings and similar discarded material. The particular mode of operation is by baling the material—a mode which is known in the art.

Waste material, such as rags and paper as well as farm crops, such as cotton, hay and stover have been baled for a long time. Such bales provide a compact and convenient form of storage for such materials.

Discarded pneumatic tire casings, however, provide many challenges not found in the baling of other materials. Whereas previously baled materials are relatively uniform in content, tire casings are formed of rubber having steel or similar materials in the bead of the tire. Steel or fabric materials form the plies of the tire. The mere fact of having a material as resilient as rubber tends to keep the form of the casing intact so that a curling of the form into a compact shape also presents unique problems, especially in loading the material to form a compact and firm bale.

Nonetheless, because tire casings also present a substantial problem of disposal, added effort to solve the problem of compacting the casing may be warranted. Tires may be shredded, and in some instances, the shredded material may be profitably recycled. However, the volume of discarded tires is overwhelming and the shredded material is not easily disposed of. Most landfill owners refuse to accept whole casings. When buried, such casings have a tendency to "float" up from the fill and again appear on the surface. Thus, disposal becomes a problem in such a landfill.

Therefore, any successful device for compacting discarded tire casings has become a desirable goal. A complete understanding of the invention may be had from a study of the following specification and the drawings.

BRIEF DESCRIPTION OF THE DRAWINGS

FIG. 14 is a detailed top view to an enlarged scale of the rear door about to be closed, FIG. 15 is an end elevational view of the parts shown in FIG. 14 showing a door safety feature, FIG. 16 is a view from line 16—16 of FIG. 15, FIG. 17 is a top plan view of the transverse bars of the ram to an enlarged scale, and FIG. 18 is a side elevational view of the bars shown in FIG. 17 to show details of the slots between those bars.

DESCRIPTION

Briefly, this invention comprises a portable baling machine particularly adapted to bale relatively resilient materials such as rubber tire casings, although it can be used for other materials. The portability, pressure applying means, and baler emptying device provide for a very convenient baling machine.

Figure 1:
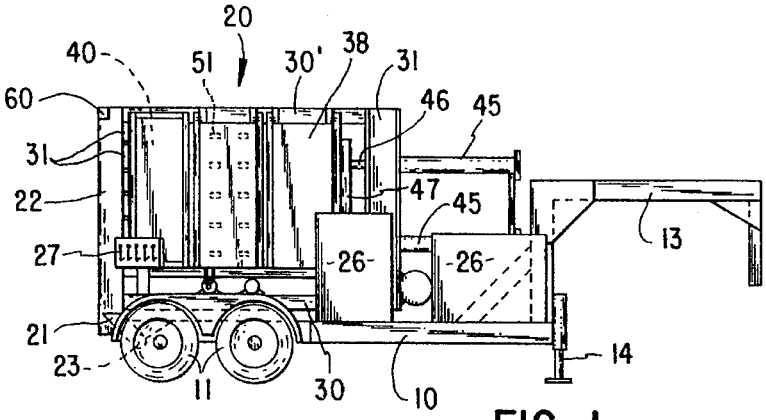
FIG. 1 is a side elevational view of the baling machine in position to be moved.
Figure 3:
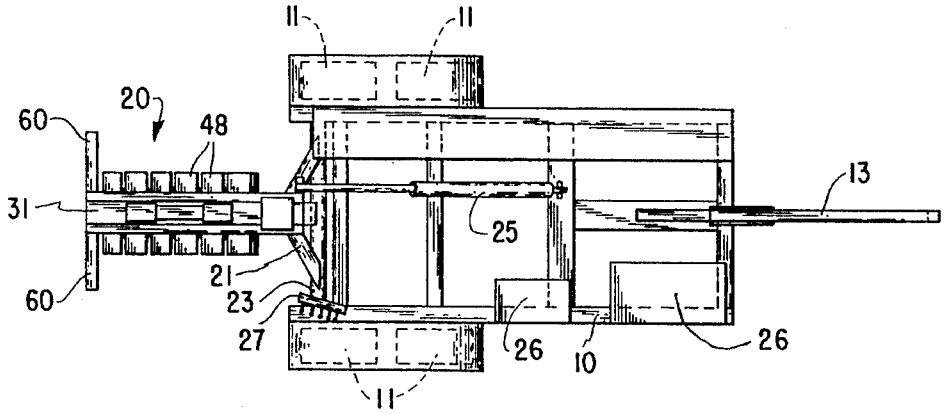
FIG. 3 is a top plan view of the device shown in FIG. 2.
Figure 2:
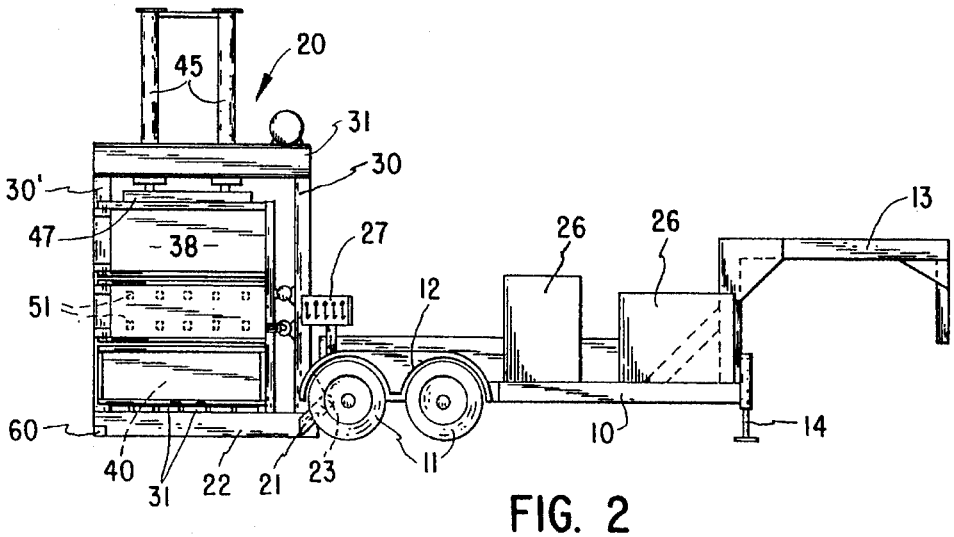
FIG. 2 is a side elevational view of the machine in a use position.

More specifically, the baler is designed to be mounted on a trailer (FIGS. 1–3). In FIG. 1 it is shown in a carrying position fully loaded. FIGS. 2 and 3 show the operating baler pivotally unloaded and resting on the ground behind the trailer. This trailer has a frame 10 which is mounted through springs (not shown) to wheels 11 which are protected by fenders 12. A "gooseneck" tongue 13 of a type well known in the field of agricultural trailers is used to connect the trailer to a towing vehicle—probably a pickup truck or other light truck. A jack 14 may be used under the tongue to support the front of the trailer when it is disconnected from the towing device.

The operating baler 20 is mounted on a yoke 21 supporting a base 22. The yoke 21 is pivoted to the frame 10 by an axle 23. Thus, the baler, while being transported (FIG. 1), lies on its side on the frame 10. When set up for use, the operating baler 20 is tilted around the axle 23 by a hydraulic device 25 engaged between the frame 10 and the yoke 21 to a point where the base 22 is set firmly on the ground. Hydraulic pumps, engines to drive the pumps, and similar necessary power and control means may be enclosed in housings 26 on the frame. Valves and manually operated controls 27 may also be mounted above the frame and on the trailer. Proper hydraulic hoses for both the tilting mechanism and the baling mechanism may all be connected in a manner well within the skill of the ordinary mechanic.

The baling device itself comprises the yoke composed of two uprights 30 and 30' along with the cross member 31. The base 22 completes a rectangular frame which encloses the press. The base provides support for the bottom of the press which is composed of a series of bars 31 extending cross ways of the base member 22. The spaces between the bars are useful as will be explained later.

A side piece 32 is supported by the upright member 30' to provide one of two opposite walls of the enclosure in which the pressing is accomplished. This side is simply a flat side across which the pressed material can slide readily while being compressed. The opposite wall is formed by wings 33 on the doors which join with an upright piece 29 to enclose the pressure chamber as described below. The wings 33, when the doors are closed, thus form a second sidewall opposite the side 32 and thus opposite to the first sidewall 32.

The front and back walls of the pressure chamber are formed by doors having somewhat unique features. The back door 35 is a unitary door and is hinged to ribs 36 fixed to the upright 30'. The front wall is formed of two doors. The upper door or door panel 38 covers approximately the top one-third of the wall. This upper door may be latched shut by any type of simple latch (shown diagrammatically at 37). Each of the doors has a wing 33 extending at right angles to the door. These wings are adapted to meet when the doors are closed to form an enclosing wall of the baling chamber opposite the wall 32 and enclosing the chamber.

The lower door panel 40 at the front of the baling chamber encloses approximately the lower two-thirds of the baling chamber. Both this lower door 40 and the rear door 35 are held closed by powered means. Each door is provided with a loop 41. The loops are firmly affixed to the edges of the doors in position to be engaged by hooks 42 which are actuated by hydraulic piston and cylinder mechanisms 43 fixed to the adjacent upright 30. By this construction, the doors 35 and 40 can be closed, the hook 42 engaged through the loops 41 and the hydraulic mechanisms thus actuated to pull the doors tightly shut. Substantial force will be executed on the doors by the pressing process so that the hydraulic mechanism must be sturdy enough to withstand the pressure. However, the principal advantage appears upon release of the pressure by opening the doors. Because the material being compressed into a bale is somewhat resilient, there is a continuing pressure to expand as the door is opened. Thus, any ordinary latch has a considerable disadvantage because of the pressure on it. By use of hydraulic mechanism, the hooks 42 can be gradually moved outward, thus gradually changing the pressure, until the baled material is essentially free from added expansion. At this point, the hooks 42 can be released from the loops 41 and the doors completely opened.

A further safety feature of the doors is shown in FIGS. 14–16. At its lowest edge, each of the lower wings 33 is provided with a roller 70 journalled in a yoke 71. On the cross member 31 in position to be engaged by the roller 70 is a hook 72. When the doors are closed, the roller 70 is engaged with the hook 72 thus effectively preventing vertical and lateral movement of the wings 33 of the door. By this means, buckling of the doors is inhibited providing added safety to the machine.

Pressure for the baling process is applied from above by a pair of hydraulic mechanisms 45 operating a pair of rams 46. The rams are attached to a pressure plate 47 which includes a series of transverse bars 48 similar to the bars 31 of the base. The bars are spaced apart for purposes related to holding the bale together as will later appear.

Casings of pneumatic tires, because of their shape and the resiliency of the material of which they are formed, create a special problem in the baling and holding the bale together. Most materials which are baled retain a more or less permanent crease when they are pressed into the form of a bale. Rubber tire casings do not. Their resilience causes them to retain their original shape after the release of any simple pressure which might cause them to compress. Therefore, in any simple compression device seeking to concentrate the tire casings, the stroke of the ram would normally be long enough to accommodate the entire load of tires necessary to make a bale. Anything less than that would make a release and second stroke of the ram necessary, and upon release, the entire load would return to substantially its original size and shape.

This invention provides a unique holding mechanism by which multiple pressings are made possible so that a much shorter stroke of the ram may be used several times to form a single, relatively large bale.

Understanding of the holding method will be enhanced by reference to FIGS. 4–10. Principally the method is one of holding partial bales in place as new material is added to complete a bale. The holding is accomplished by use of prongs or fingers 50 pivoted to the lower front door 40 and to the rear door 35 at the top of slots 51 cut into these doors. The slots 51 are located at vertical levels slightly above that to which the baled material would be compressed if the baling chamber were fully charged and then compressed. The fingers 50 are biassed to a horizontal position by springs 52 (FIGS. 6 and 7) and are prevented from going above that level by contact between the upper side of each finger and the top of the slot 51 through which the finger extends.

Figure 5:
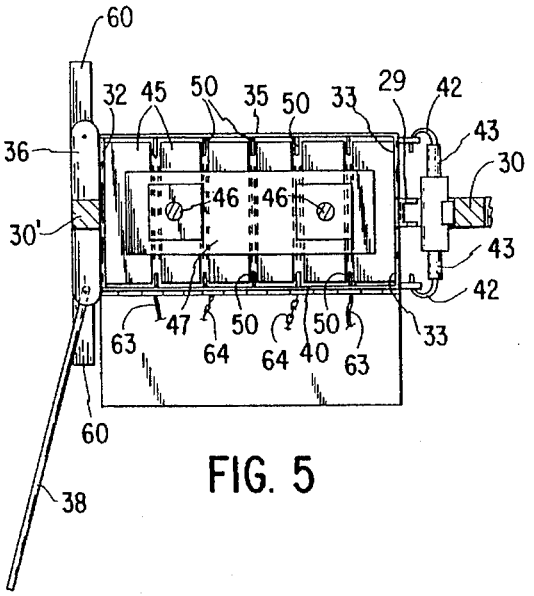
FIG. 5 is a sectional view from line 5—5 of FIG. 4.
Figure 6:
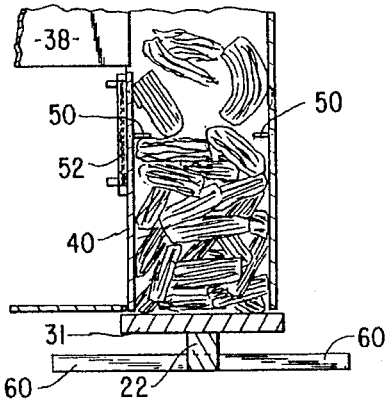
FIG. 6 is a sectional view from line 6—6 of FIG. 4 showing the baling hopper partially filled.
Figure 9:
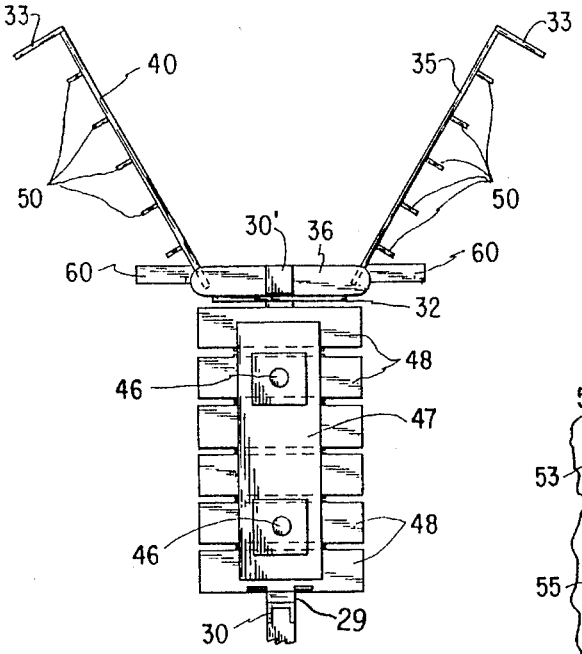
FIG. 9 is a top view of the machine as shown in FIG. 8.
Figure 11:
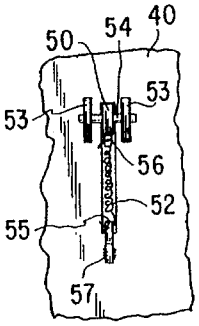
FIG. 11 is a detailed view to an enlarged scale of the end of one of the holding fingers.
Figure 12:
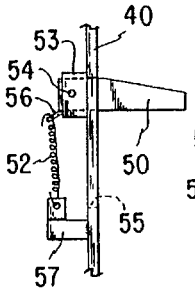
FIG. 12 is a side view of the finger of FIG. 11 in a horizontal position.
Figure 13:
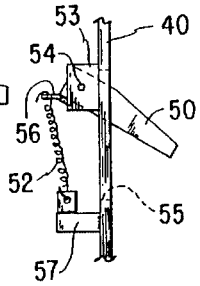
FIG. 13 is a view similar to FIG. 12 with the finger in a depressed position.

The fingers 50 and the details of their operation are best shown in FIGS. 11, 12 and 13. As shown in those figures, the fingers 50 are pivoted to ears 53 fixed to the door 40 on an axle 54. The finger extends through a slot 55 in the door, and into the chamber as shown in FIGS. 5 and 6. The tension spring 52 is engaged between a plate 56 on the exterior end of the tooth and a bracket 57 on the door so there is a bias on the tooth to hold it horizontally as shown in FIG. 12. The tooth 50 is normally held in that position by contact between the upper surface of the tooth and the upper surface of the slot. However, if sufficient force is applied to the interior end of the tooth, the tooth can be displaced downward as shown in FIG. 13 against the force of the spring 52. Full displacement beyond that shown in FIG. 13 provides for almost a continuous surface with the interior of the doors 35 and 40.

It is now possible to understand the use of this device and many of its benefits. Certain details will be explained in connection with the description of its use.

One of the principal benefits of the device is the easy portability. As described, the baler 20 is normally carried lying on its side on the frame 10 of the trailer. When the device has been relocated at the location in which it is to be used, the trailer can be stopped in the proper place and the hydraulic mechanism 25 actuated by use of the controls 27. Such actuation will cause the baler to be lifted from the frame 10 and pivoted about the axle 23 to an upright position as shown in FIG. 2. In this position, the baler stands on its base 22 and is steadied by the use of transverse feet 60.

When the baler is firmly set, the rams 46 can be raised and the front door panels 38 and 40 opened. Before loading the baler, retaining wires 63 are placed in at least two or preferably three of the grooves between the lower bars 31 (FIG. 8) so that they can be wrapped around the bales when those bales are completed. Chains 64 also have one end fixed between the bars 31 on the base near the rear door and extend toward the front for purposes to be explained later.

Figure 7:
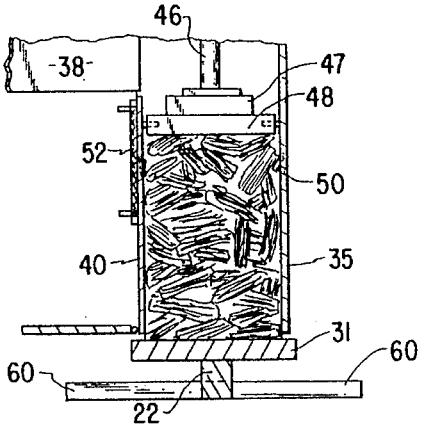
FIG. 7 is a view similar to FIG. 6 with the hopper substantially filled.
Figure 4:
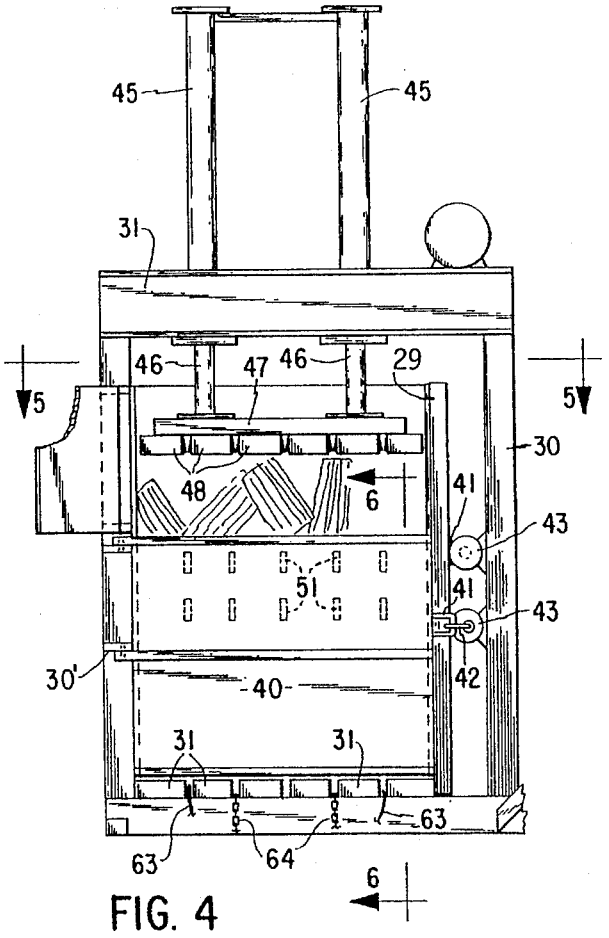
FIG. 4 is an elevational view of the baling machine apart from its carrier trailer.

Loading of the baler is now possible. Early loading may be done with the back doors 35 closed and both parts 38 and 40 of the front door open. Tire casings or parts thereof are placed so as to generally be enclosed in the baling compartment. The material is arranged so that it is interlaced and is not all neatly stacked on a single axis. The casing sides should extend over each other so as to hold the casings in a good shaped bale when pressure is released. Some demonstration of this interlacing is shown in FIGS. 6 and 7.

As the pile of casings grows, the lower panel 40 of the front door is closed and the casings are piled higher until reaching the point at which it becomes necessary to close the upper panel 38 to contain the casings. When the pile fills the baling enclosure defined by the doors 38, 40 and 35 and the side walls 32, then the press can be operated to bring the bars 48 against the top of the pile and to press that downward to express the air from between and within the casings and then to collapse the pile. As the press moves the stack downward, some of the upper casings in the pile will tend to move past the fingers 50. The fingers 50 will first be displaced downward against the bias of the springs 52 and then, as an open space goes past the finger 50, that finger will again snap outward to an extended position. In that extended position, the finger will engage the top of the adjacent casing to hold it in its depressed position. The finger may also be extended if the pile of casings is allowed to expand upward slightly. In either case, the set of fingers will tend to hold down the stack of material below the fingers while the press can be retracted and more casings added to the stack. Successive strokes of the press will further compact the stack into a bale form. When the bale is completed and the front doors opened, the retaining wires 63 between the bars 48 on the press and the ends can be fastened together. Applicant prefers to use wires with pre-formed fastening devices on each end of the wires 63, but any sort of means or method of fastening may be used.

The bars 48, as noted, are spaced apart to allow grooves 58 therebetween (FIGS. 17 and 18). As shown in FIG. 18, the walls 59 of the grooves 58 are tapered to form a more narrow opening of the slot at the face where the pressure is applied to the tire casings. This allows adequate room for the retaining wires 63 to extend between the bars 48 while inhibiting movement of rubber material into the slots 48 and clogging those slots.

Figure 8:
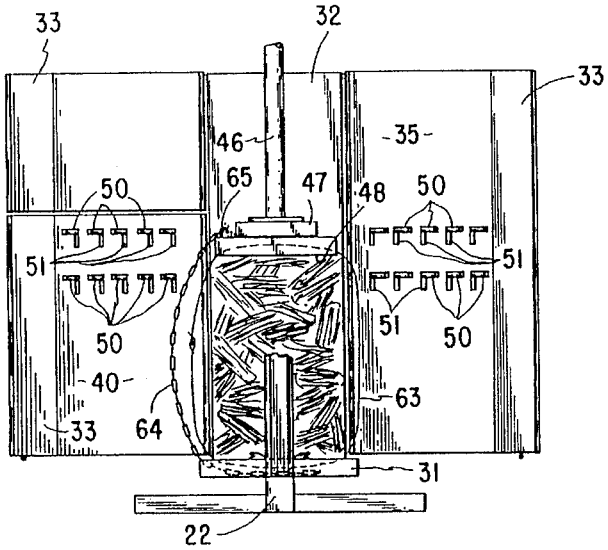
FIG. 8 is an end view of the machine shown in FIG. 4 with the doors open and the bale in place prior to raising the ram.
Figure 10:
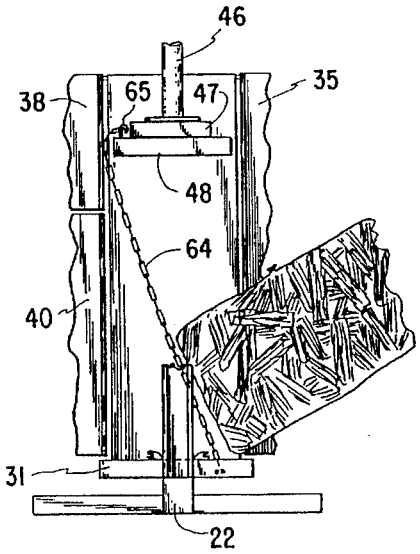
FIG. 10 is a view similar to FIG. 8 showing the ram, raised and a bale being ejected from the hopper.

The chains 64 can also then be brought upward from their lower position between the bars 31 and looped over hooks 65 on a couple of bars 48 (FIGS. 8 and 10). Raising the press to the position shown in FIG. 10 will then pull the chain 64 to cause the bale to tilt and be ejected when the rear door 35 is open. After the ejection, the press is lowered, the chain 64 is unhooked, new wires 62 placed in the slots between the bars 31 on the bar, and the rear door 35 and lower panel 40 closed and the baler is again ready for loading. Or the empty baler could again be retracted onto trailer by use of the hydraulic mechanism 25, and the entire assembly then can be readily transported to a new location.

It will be apparent that a conveniently portable device for the baling of used tire casings is made available by this invention. It will also be evident that while the device is described in connection with automobile tires, larger tires may also be baled although it might be desirable to cut such larger tires into pieces more readily handled. Material other than tires may also be baled although the principal benefits are most useful with material which is highly resilient, or contains large amounts of air so that multiple operations of the press are necessary for complete compression and baling of the material.

I claim as my invention:

1. A baling machine comprising:

a base;

a first sidewall extending upward from a first side of said base;

an upright sidewall piece extending upward from a side of said base opposite to said first side, said upright sidewall piece forming at least part of a second sidewall opposite to said first sidewall, a front opening and a rear opening formed between the first sidewall and the second sidewall;

a front closure means and a rear closure means for closing the front opening and the rear opening between said first sidewall and said second sidewall, the front closure means and the rear closure means each including a main closure portion and a wing closure portion which extends transversely to the main closure portion, the two wing portions contacting the upright sidewall piece when the front closure means and the rear closure means are closed to complete the formation of the second sidewall, and thus forming a baling chamber;

vertical upright members on said base and extending upward therefrom;

press means mounted on said upright members and including a pressure plate adapted to be moved by said press means inside said baling chamber to compress any material placed within said chamber.

2. The machine of claim 1 in which said front closure means are formed with vertical slots, fingers extending through said slots and into said chamber, said fingers being pivotally mounted on said front closure means, and biasing means engaged between said front closure means and said fingers whereby said fingers are biassed to a normal position extending into said chamber.

3. The machine of claim 2 in which said front closure means is divided into an upper door panel and a lower door panel, each of said door panels being hinged to one of said sidewalls and each of said door panels being separately latched to the other of said sidewalls.

4. The machine of claim 3 in which said fingers are mounted on said rear closure means and on said lower panel of said front closure means.

5. The machine of claim 2 in which hook means on said base engages loop means on a lower edge of each of said closure means whereby substantial vertical movement of said closure means is prevented.

6. The machine of claim 5 in which said loop means includes a roller engageable with said hook means.

7. The machine of claim 2 in which said base is formed of a plurality of base bars extending from said front closure means when closed toward said rear closure means when closed, said base bars being spaced from each other to form grooves between said base bars, said grooves being adapted to receive bale holding wires.

8. The machine of claim 7 in which said pressure plate also carries a plurality of press bars substantially parallel to said base bars, said press bars being spaced to form grooves therebetween.

9. The machine of claim 8 in which said grooves between said press bars have slanting walls defining a tapered cross section of said grooves between said press bars, said tapered cross section being narrower at the bottom than at the top to avoid movement of material into said grooves.

10. The machine of claim 8 in which at least one chain is fastened to said base adjacent said rear closure means, said chain lying in grooves between said base bars, hook means on said press bars to receive said chain in releasable engagement, said chain being of a length to be pulled taut when said press means is retracted.

11. The machine of claim 2 in which said press means comprises at least two hydraulic cylinder/piston assemblies in parallel relationship.

* * * * *